US005210877A

United States Patent [19]

Newman

[11] Patent Number: 5,210,877

[45] Date of Patent: May 18, 1993

[54] ABRASION AND CUT RESISTANT PROTECTIVE CLOTHING FOR BICYCLING

[76] Inventor: Howard J. Newman, 1705 Locust Hill Rd., Richmond, Va. 23233

[21] Appl. No.: 771,240

[22] Filed: Oct. 4, 1991

[51] Int. Cl.[5] ..... A41D 13/00

[52] U.S. Cl. ..... 2/2; 2/115; 2/227; 2/228; 2/243 A

[58] Field of Search ..... 2/2, 2.5, 22, 92, 2.1 R, 2/238, 115, 227, 79, 23, 16, 122, 228, 243 A

[56] References Cited

U.S. PATENT DOCUMENTS

| | | | |
|---|---|---|---|
| 4,280,342 | 7/1981 | Eng et al. | 2/2 |
| 4,688,269 | 8/1987 | Maeshima | 2/2 |
| 4,732,803 | 3/1988 | Smith, Jr. | 2/6 |
| 4,737,401 | 4/1988 | Harpell et al. | 2/2.5 |
| 4,810,559 | 3/1989 | Fortier et al. | 2/2 |
| 4,838,017 | 6/1989 | Kolmes et al. | 2/167 |
| 4,858,245 | 8/1989 | Sullivan et al. | 2/169 |
| 4,912,781 | 4/1990 | Robins et al. | 2/161 R |
| 5,014,354 | 5/1991 | Dumont | 2/2 |
| 5,023,953 | 6/1991 | Bettcher | 2/16 |
| 5,087,499 | 2/1992 | Sullivan . | |

FOREIGN PATENT DOCUMENTS

| | | | |
|---|---|---|---|
| 2841290 | 4/1980 | Fed. Rep. of Germany | 2/2 |

*Primary Examiner*—Clifford D. Crowder
*Assistant Examiner*—Amy Brooke Vanatta

[57] ABSTRACT

Outerwear for bicyclists which substantially protects the rider from cuts and abrasions in the event of a fall or crash, particularly of bicycle racers. The outerwear is constructed with protective fabric panels containing abrasion and cut resistant high performance fibers or yarn, such as ultra high molecular weight polyethylene: The fibers or yarn are woven, knitted, or knit-woven with conventional man made or natural fibers or yarn so that they are evenly distributed through the protective panels. The protective panels are structural components of the garment and are sewn or otherwise attached to panels or sections of conventional textile to complete the garment. The upper outerwear defines a pair of arm openings, a waist opening, and a neck opening. Protective panels on and upper outerwear are placed to protect the shoulders, outer arms, and upper back of the wearing. The lower outerwear defines a waist opening and a pair of leg openings. The lower outerwear contains abrasion and cut resistant panels placed to protect the hips and outer thighs, knees, and buttocks of the wearer. The outerwear is effective to retain the abrasion resistant panels in place over or against the body of the wearer while riding a bicycle and on body impact with the road or riding surface.

5 Claims, 3 Drawing Sheets

ABRASION AND CUT RESISTANT PROTECTIVE CLOTHING FOR BICYCLING

FIELD OF THE INVENTION

The present invention relates to protective outerwear for bicycle racers and recreational bicyclists.

BACKGROUND AND DESCRIPTION OF PRIOR ART

In the sport of bicycling, recreational riders may attain speeds over 35 miles per hour. In competitive bicycle races, riders may attain speeds in excess of 60 miles per hour. At these speeds, impact with the riding surface at these speeds results in extensive and sometimes serious abrasions and lacerations of the back, legs, and arms.

Currently, the only protective gear or articles of clothing used by recreational bicyclists and licensed amateur racing bicyclists are helmets or protective gloves.

For many years, wearing bicycle helmets met with considerable resistance. Recreational riders felt it unnecessary, and competitive racers did not want the additional weight which reduced speed. It was not until the relatively recent introduction of aerodynamic, ventilated, bicycle helmets constructed with lightweight plastics that helmets became accepted and a requirement for competitive racing. The widespread use of bicycle helmets resulted in a well documented reduction in head injuries.

While helmets have significantly reduced head injuries, serious skin abrasions and lacerations regularly occur in competitive bicycle races. Bicycle racers refer to this injury as road rash, and, unfortunately, have accepted this risk as part of the sport. These injuries affect the upper and lower back, shoulders, upper arms, knees, buttocks, and outer aspects of the hips and thighs. At most any sanctioned competitive bicycle race it is common to find a paramedic providing first aid to a fallen rider whose lacerated and bleeding skin is exposed through shredded bicycle clothing.

Heretofore, bicycle protective clothing used by recreational and racing bicyclists was constructed only with conventional fabric such as acrylic, polyester, nylon, wool, cotton, spandex (Lycra TM), or blends of these fabrics. None of these fabrics offer bicyclists material protection from skin abrasions or lacerations resulting from high speed body contact with pavement or similar abrasive and resistant surfaces. The primary purpose of currently available clothing designed specifically for bicycling is to provide an attractive, functional, comfortable, lightweight, and tight fitting covering which reduces the loss of body heat and blocks the wind.

As in the case of the initial introduction of protective bicycle helmets, there is resistance to wearing any external padding or rigid armor. Racing bicyclists will not wear clothing containing extra padding or multiple layers of fabric (except in the saddle area) as this would add weight, prevent the evaporation of perspiration, increase wind resistance, cause friction and irritation over skin areas requiring protection, and reduce freedom of movement. Additionally, it is bulky and unattractive, and as with most sports, styling and looks are important. There is need for functional and protective clothing that will be worn by bicyclists.

SUMMARY OF THE INVENTION

Applicant, by way of the present invention, seeks to disclose exemplary and functional outerwear for bicycling that provides protection from abrasions and lacerations. This is accomplished by manufacturing a garment containing highly flexible protective fabric panels which are positioned to cover those parts of the body at greatest risk while bicycling. The protective fabric panels contain SPECTRA TM brand fibers or yarn, or other high performance fibers or yarn, and either wool, or acrylic, nylon, polyester, spandex, or other natural or manmade fiber. The protective fabric panels are either knitted, woven, or knit-woven depending upon the physical and performance requirements of that portion of the bicycle outerwear covering the body. The balance of the garment does not contain Spectra TM or other high performance fibers or yarn, and is made only from conventional fabric typically used in the manufacturing bicycle outerwear.

SPECTRA is a trademark of Allied Signal, Inc., Petersburg, Va., for its highly abrasion resistant fiber spun from a solution of ultra high molecular weight polyethylene. SPECTRA TM is very lightweight, with a specific gravity of 0.97, and is a desirable material for use in bicycle outerwear. With a moisture regain of less than 1% it retains little or no perspiration. It will not shrink, can be washed in hot water and detergent, and dried in a hot air dryer. SPECTRA TM fiber yarn is highly flexible and may be knitted, woven, or knit-woven with other conventional yarn depending upon the structural requirements of the textile. SPECTRA fibers may also be wrapped around spandex fibers such as LYCRA TM to create a protective and elastic yarn for use in bicycle shorts or tights.

Applicant has determined that recreational and competitive bicycle riders demand clothing that permits complete freedom of movement, is relatively skin tight to reduce wind resistance, lightweight, non irritating, and permits the evaporation of perspiration through its surface. Since the protective panels are an integral part of the garment, and not an additional layer of fabric over the body, my outerwear for bicycle riding effectively meets these requirements.

SPECTRA TM fiber is currently regarded as number one in cut and abrasion resistance. Another advantage to my bicycling outerwear is that in event of serious injury, balance of the garment made with conventional non-protective fabric may be easily cut or torn to expose the injured area for emergency care.

These and other objects, advantages and novel features of the present invention will become more apparent from the following description when taken in connection with the accompanying drawings which show for the purposes of illustration only, plural embodiments in accordance with the present invention, and wherein:

DETAILED DESCRIPTION OF THE DRAWINGS

Figure 1:
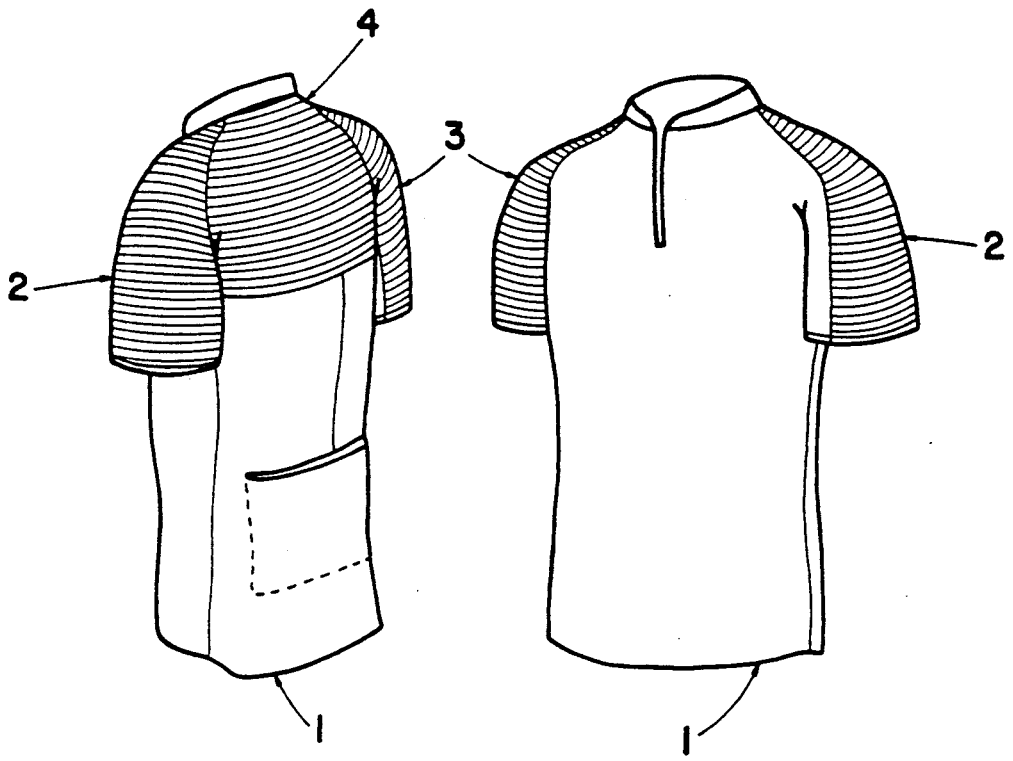
FIG. 1 shows a short sleeve bicycle jersey constructed with said protective panels in the shoulders, the outer aspects of the sleeves, and upper back.

FIG. 1 depicts a short sleeve form fitting bicycle jersey 1 constructed with said protective panels 2 and 3 which cover the area of the shoulders and extend down the sleeves to cover the outer aspect of the upper arms. The jersey 1 may contain an additional protective panel to cover the area of the upper back panel 4 if desired for additional protection. The balance of the garment is constructed with conventional fabric used for bicycle jerseys.

Figure 2:
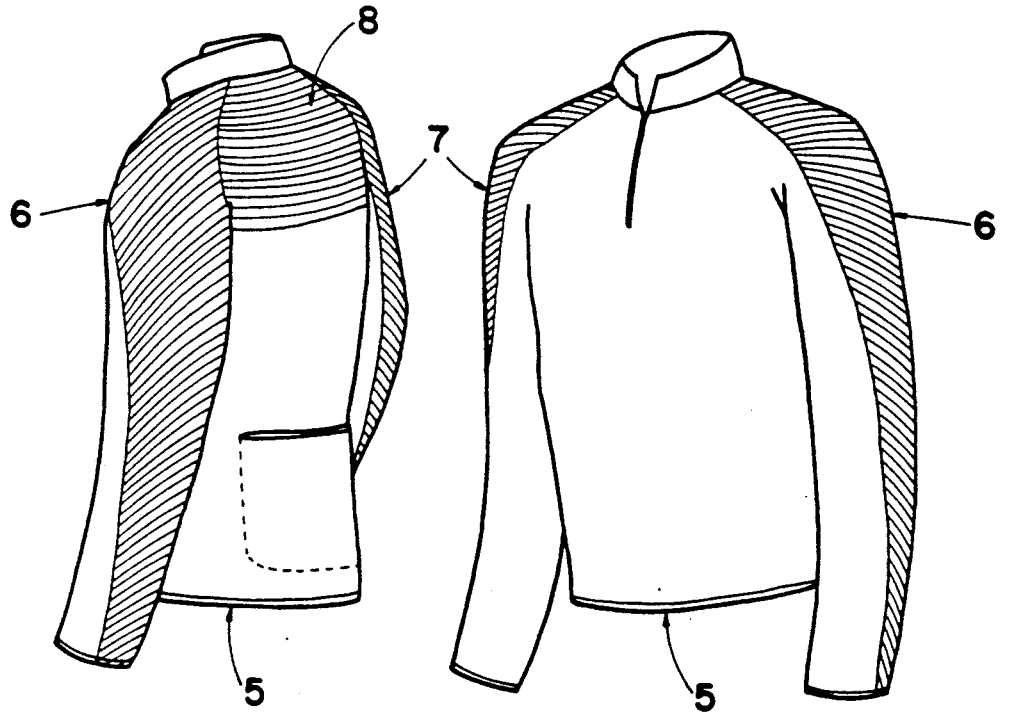
FIG. 2 shows a long sleeve bicycle jersey or shell constructed with said protective panels in the shoulders, the outer aspects of the sleeves, and upper back.

A long sleeve form fitting bicycle jersey or shell 5 with the preferred embodiments is depicted in detail in FIG. 2. The jersey or shell 5 is constructed to include said protective panels 6 and 7 which cover the area of the shoulders and extend down the sleeves to cover the outer aspect of the upper and lower arms. An additional panel 8 may cover the area of the upper back if additional protection is desired. The balance of the garment is constructed with conventional fabric used for bicycle jerseys.

Figure 3:
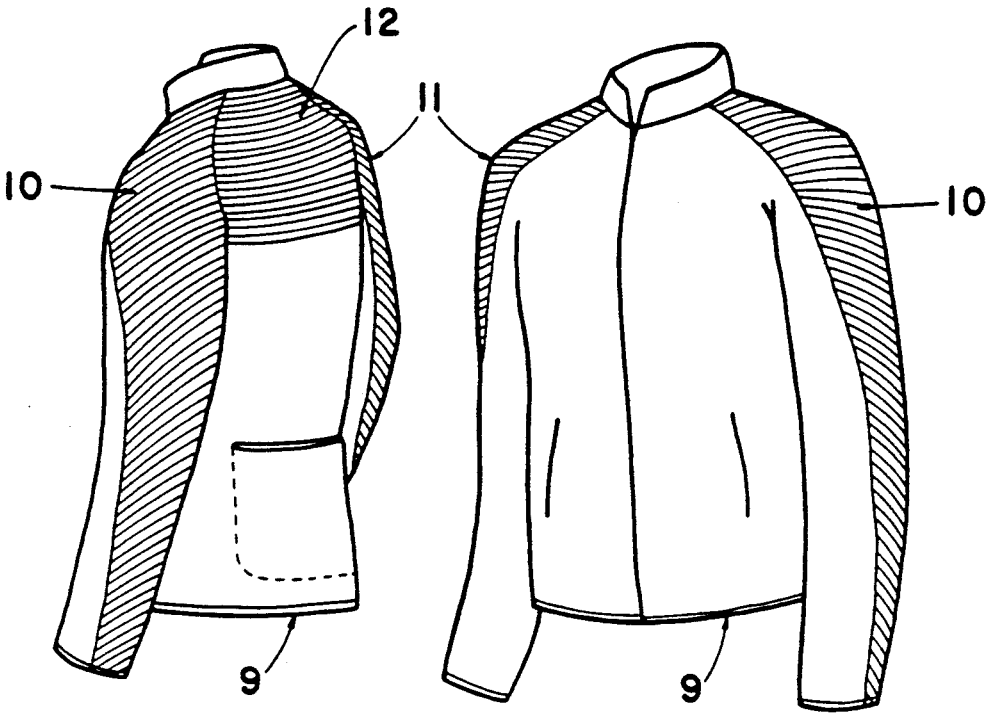
FIG. 3 shows a bicycle jacket constructed with said protective panels in the shoulders, the outer aspects of the sleeves, and upper back.

Referring to FIG. 3, a detailed view of a bicycle jacket 9 is shown. Such jackets are designed to be close fitting to minimize wind drag yet provide considerable freedom of movement. The jacket 9 is constructed to include said protective panels 10 and 11 which cover the area of the shoulders and extend to down the sleeves to cover the outer aspects of the upper and lower arms. An additional panel 12 may cover the area of upper back of the rider if additional protection is desired. The balance of the garment is constructed with conventional fabric used for bicycle jackets.

Figure 4:
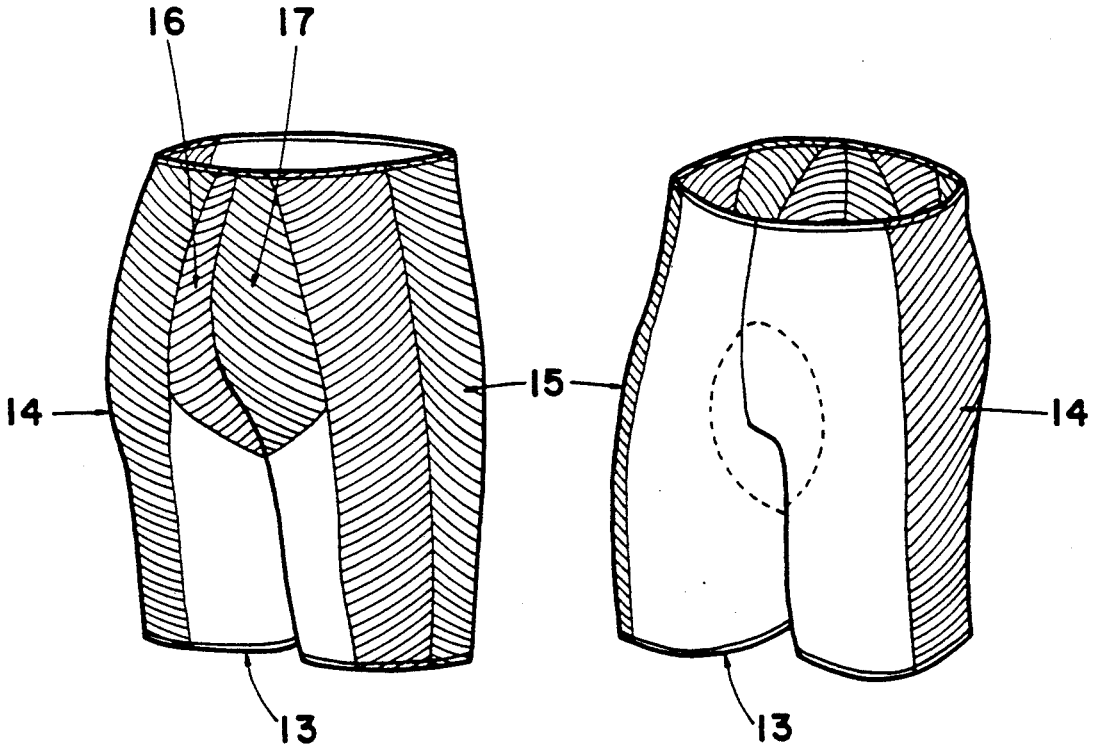
FIG. 4 shows a pair of bicycle shorts constructed with said protective panels in the outer aspects of the hips and thighs, and over the buttocks.

In FIG. 4 a pair of bicycle shorts 13 is shown in detail, constructed with said protective panels 14 and 15 positioned to cover the hips and outer thighs, and additional protective panels 16 and 17 to cover the area of buttocks. The balance of the garment is constructed with conventional fabric used for bicycle shorts.

Figure 5:
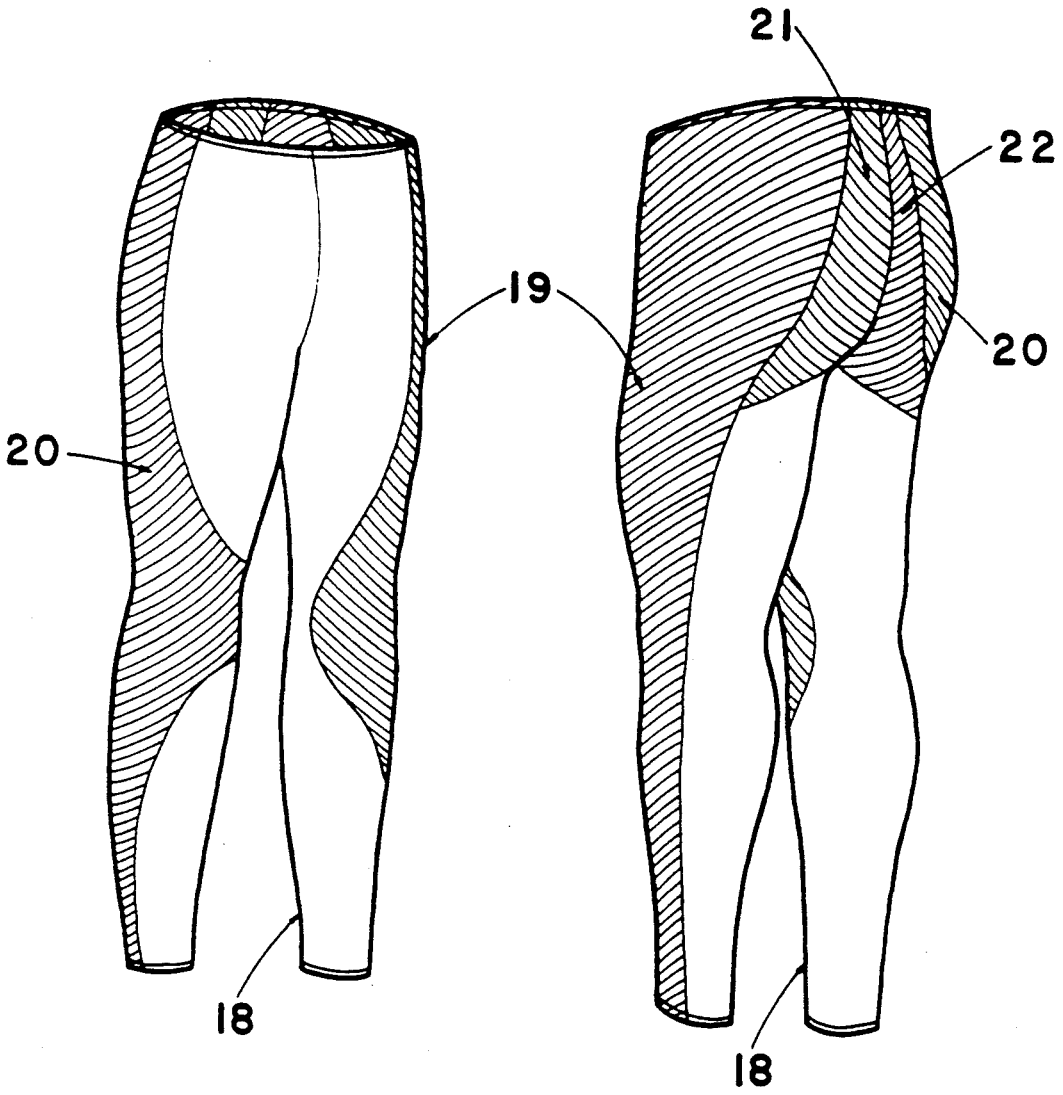
FIG. 5 shows a pair of bicycle tights constructed with said protective panels in the outer aspects of the hips, thighs and legs; over the knees; and over the buttocks.

Referring to FIG. 5, a pair of long leg bicycle tights 18 is shown in detail, constructed with said protective panels 19 and 20 which are positioned to cover the hips, outer thighs, knees, and additional protective panels 21 and 22 positioned to cover the area of the buttocks. The balance of the garment is constructed with conventional fabric used for long leg bicycle tights.

List of Reference Numerals 1 bicycle jersey, short sleeve
2 protective panel, bicycle jersey, short sleeve, left shoulder and upper arm
3 protective panel, bicycle jersey, short sleeve, right shoulder and upper arm
4 protective panel, bicycle jersey, short sleeve, back
5 bicycle jersey, long sleeve
6 protective panel, bicycle jersey or shell, long sleeve, left shoulder and arm
7 protective panel, bicycle jersey or shell, long sleeve, right shoulder and arm
8 protective panel, bicycle jersey or shell, long sleeve, back
9 bicycle jacket
10 protective panel, bicycle jacket left shoulder and sleeve
11 protective panel, bicycle jacket right shoulder and sleeve
12 protective panel, bicycle jacket back
13 bicycle shorts
14 protective panel, bicycle shorts, left hip and thigh
15 protective panel, bicycle shorts, right hip and thigh
16 protective panel, bicycle shorts, left buttock
17 protective panel, bicycle shorts, right buttock
18 bicycle tights
19 protective panel, bicycle tights, left leg
20 protective panel, bicycle tights, right leg
21 protective panel, bicycle tights, left buttocks
22 protective panel, bicycle tights, right buttock While I have shown and described plural embodiments in accordance with the present inventions, it is understood that the same is not limited thereto but is susceptible to numerous changes and modifications as known to one having ordinary skill in the art, and I therefore do not wish to be limited to cover all such modifications as are encompassed by the scope of the appended claims.

I claim:

1. Protective outerwear worn for bicycling comprising:

separate, single layer, lightweight, abrasion resistant, woven, knit, or knit-woven protective fabric panels comprising ultra high molecular weight polyethylene fiber of approximately 215 denier, for protection of a bicyclist's body from abrasion due to moving contact with a road surface;

wherein said protective outerwear is a short sleeve bicycle jersey comprising one said protective fabric panel located at a rear yoke region behind the neck and shoulders of a wearer and extending the width of the wearer's back to a pair of sleeve openings; two tubular short sleeves attached to the sleeve openings, each said sleeve comprising one said protective panel extending over and covering the outer regions of the wearer's shoulder and upper arm; and said yoke region and sleeves of the outerwear consist of a single layer of fabric;

wherein the protective panels are located only in said yoke region and sleeves of the jersey.

2. Protective outerwear worn for bicycling, comprising:

separate, single layer, lightweight, abrasion resistant, woven, knit, or knit-woven protective fabric panels comprising ultra high molecular weight polyethylene fiber of approximately 215 denier, for protection of a bicyclist's body from abrasion due to moving contact with a road surface;

wherein said protective outerwear is a long sleeve bicycle jersey comprising one said protective fabric panel located at a rear yoke region behind the neck and shoulders of a wearer and extending the width of the wearer's back to a pair of sleeve openings; two tubular long sleeves attached to the sleeve openings, each said sleeve comprising at least one said protective panel extending over and covering the outer regions of the wearer's shoulder, upper arm, elbow, and lower arm to the wrist; and said yoke region and sleeves of the outerwear consist of a single layer of fabric;

wherein the protective panels are located only in said yoke region and sleeves of the jersey.

3. Protective outerwear worn for bicycling comprising:

separate, single layer, lightweight, abrasion resistant, woven, knit, or knit-woven protective fabric panels comprising ultra high molecular weight polyethylene fiber of approximately 215 denier, for protection of a bicyclist's body from abrasion due to moving contact with a road surface;

wherein said protective outerwear is a long sleeve bicycling jacket comprising one said protective fabric panel located at a rear yoke region behind the neck and shoulders of a wearer and extending the width of the wearer's back to a pair of sleeve openings; two tubular long sleeves attached to the sleeve openings; each said sleeve comprising at least one said protective panel covering the outer regions of the wearer's shoulder, upper arm, elbow, and lower arm to the wrist; and said yoke region and sleeves of the outerwear consist of a single layer of fabric;

wherein the protective panels are located only in said yoke region and sleeves of the jersey.

4. Protective outerwear worn for bicycling comprising:

separate, single layer, lightweight, abrasion resistant, woven, knit, or knit-woven protective fabric panels comprising ultra high molecular weight polyethylene fiber of approximately 215 denier, for protection of a bicyclist's body from abrasion due to moving contact with a road surface;

wherein said protective outerwear is bicycling shorts having two tubular leg portions, a front portion, a rear buttocks portion, a waist opening, and two leg openings located above the knees of a wearer, further comprising at least one said protective panel in the buttocks portion of the shorts, said at least one panel extending laterally to cover the width of the wearer's lower back and hips and extending downwardly to cover the buttocks; at least two said protective panels, each in an outer thigh portion of each leg portion of the shorts, each said panel extending downwardly from the waist opening to the leg opening and covering the hips and outer thighs of the wearer; and said buttocks portion and outer thigh portions of the outerwear consist of a single layer of fabric;

wherein the protective panels are located only in said buttocks portion and outer thigh portion of the shorts.

5. Protective outerwear worn for bicycling comprising:

separate, single layer, lightweight, abrasion resistant, woven, knit, or knit-woven protective fabric panels comprising ultra high molecular weight polyethylene fiber of approximately 215 denier, for protection of a bicyclist's body from abrasion due to moving contact with a road surface;

wherein said protective outerwear is full length bicycling tights having two tubular leg portions, a front portion, a rear buttocks portion, a waist opening, and two leg opening located at the ankles of a wearer, further comprising at least one said protective panel in the buttocks portion of the tights, said at least one panel extending laterally to cover the width of the wearer's lower back and hips and extending downwardly to cover the buttocks; at least two said protective panels, each in a leg portion of the tights, each said panel extending downwardly from the waist opening and covering the hips, outer thighs, and knees of the wearer, each said panel covering the outer region of the leg from the waist opening down to the opening; and said buttocks portion and leg portion of the outerwear consist of a single layer of fabric;

wherein the protective panels are located only in said buttocks portion and leg portions of the tights.

* * * * *